US011519686B1

(12) United States Patent
Kushner

(10) Patent No.: US 11,519,686 B1
(45) Date of Patent: Dec. 6, 2022

(54) PROJECTILE LAUNCHING DEVICE AND RELATED METHODS

(71) Applicant: UT Brands LLC, San Diego, CA (US)

(72) Inventor: Robert Kushner, San Diego, CA (US)

(73) Assignee: UT BRANDS LLC, San Diego, CA (US)

( * ) Notice: Subject to any disclaimer, the term of this patent is extended or adjusted under 35 U.S.C. 154(b) by 0 days.

(21) Appl. No.: 17/531,096

(22) Filed: Nov. 19, 2021

(51) Int. Cl.
*F41B 3/02* (2006.01)
*A63H 33/18* (2006.01)

(52) U.S. Cl.
CPC ..... *F41B 3/02* (2013.01); *A63H 33/18* (2013.01)

(58) Field of Classification Search
CPC ..... F41B 3/02; A63H 33/18
USPC ..... 124/17, 1
See application file for complete search history.

(56) References Cited

U.S. PATENT DOCUMENTS 2,367,249 A * 1/1945 Walker ..... F41B 3/02 124/17
2,753,657 A * 7/1956 Taggart ..... A63H 27/12 446/34
2,970,839 A * 2/1961 Halverson ..... F41B 3/02 473/578
3,299,564 A * 1/1967 Quercetti ..... A63H 27/14 124/31
3,802,409 A * 4/1974 Mike ..... A63B 69/407 124/79
4,050,438 A 9/1977 Pfotenhauer
4,240,396 A * 12/1980 Randoll ..... F41B 3/02 473/588
5,127,389 A * 7/1992 Magnuson ..... F41B 3/02 124/20.1
5,154,515 A * 10/1992 Haynes ..... A63B 65/127 124/17
5,190,021 A * 3/1993 Hull ..... F41B 3/02 124/35.1
5,249,564 A * 10/1993 Peachey ..... A63B 69/40 124/81
5,334,079 A 8/1994 Gentile et al.
5,398,665 A * 3/1995 Carlson ..... F41B 3/02 124/20.1
5,421,783 A * 6/1995 Kockelman ..... A63G 31/00 482/43
5,996,565 A * 12/1999 Whitmer ..... F41B 3/02 124/17
6,884,188 B2 * 4/2005 Cherry ..... A63B 69/407 473/422

(Continued)

OTHER PUBLICATIONS

Tatertoys, Beast 300 Yd Water Balloon Slingshot/Cannon/ Launcher, Amazon.com, accessed on Oct. 11, 2021, https://www.amazon.com/300-Yard-Balloon-Slingshot-Cannon-Launcher/dp/B00AL57GEW.

*Primary Examiner* — Alexander R Niconovich
(74) *Attorney, Agent, or Firm* — Umberg Zipser LLP

(57) ABSTRACT

Devices, systems and methods are described for launching a projectile. Preferred devices comprise two separate platforms that are connected by an elastic cable. Each of the platforms can be secured to one foot or shoe of a user by a strap or other fastener. Once secured, a force can be applied to a projectile that is connected to the elastic cable to thereby stretch the cable in a first direction. Once the force is removed, at least some of the elastic force of the cable can be transferred to the projectile causing the projectile to be propelled in a direction opposite to the first direction.

19 Claims, 18 Drawing Sheets

(56) References Cited

U.S. PATENT DOCUMENTS

| | | | | |
|---|---|---|---|---|
| 8,863,731 | B2 * | 10/2014 | Chen | F41B 3/02 124/17 |
| 9,927,203 | B1 * | 3/2018 | Shapiro | F41B 3/02 |
| 10,712,117 | B1 * | 7/2020 | Miller | F41B 3/02 |
| 2009/0011870 | A1 * | 1/2009 | Neal | A63B 69/40 473/613 |
| 2012/0125266 | A1 * | 5/2012 | Ying | F41B 3/02 119/707 |
| 2014/0196707 | A1 | 7/2014 | Binkley et al. | |
| 2014/0261352 | A1 * | 9/2014 | Loetz | F41B 7/02 473/614 |
| 2016/0003573 | A1 * | 1/2016 | Johnston | F41B 3/02 280/504 |
| 2016/0153737 | A1 * | 6/2016 | Pena | F41B 7/003 124/17 |
| 2019/0224583 | A1 * | 7/2019 | Gulick | F42B 39/00 |
| 2019/0247763 | A1 * | 8/2019 | Robbins | A63H 33/22 |

* cited by examiner

PROJECTILE LAUNCHING DEVICE AND RELATED METHODS

FIELD OF THE INVENTION

The field of the invention is projectile launchers.

BACKGROUND

The following description includes information that may be useful in understanding the present invention. It is not an admission that any of the information provided herein is prior art or relevant to the presently claimed invention, or that any publication specifically or implicitly referenced is prior art.

Various devices exist for launching projectiles including slingshots, pump, or air-powered systems, and so forth. However, such systems can be difficult to use for younger users who may not have the hand-strength or body weight to properly launch a projectile.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for innovative projectile launching systems and methods that utilize a combination of strength and weight of a user to launch a projectile efficiently.

SUMMARY OF THE INVENTION

The inventive subject matter provides apparatus, systems, and methods for launching a projectile. Preferred devices comprise first and second platforms connected together by an elastic strap. Each of the platforms may comprise a generally rectangular shape that is sized and dimensioned to be placed underneath a portion of a foot of a user or operator. Rectangular or ovular shapes are preferred to help distribute any force applied to the user's foot and facilitate a comfort of the user when barefoot. In some embodiments, at least one end of the platforms may have rounded corners. Of course, other shapes could be used so long as the platform can be placed underneath a foot of the user.

As used herein, the term "elastic" is defined to mean a length of the strap can be increased at least 20% when sufficient force is applied based on the elastic modulus of the strap, but the strap will return to its initial length when the force is removed.

Each of the first and second platforms can comprise one or more straps or other fasteners configured to secure the platform to a foot or shoe of the operator. In one embodiment, each of the platforms comprises one or more straps that are configured to wrap about a portion of the foot or shoe of the operator. It is contemplated that the straps could be secured in place via a hook and loop fastener, a buckle, or other commercially suitable means.

In another embodiment, each platform could comprise a different fastener. Rather than a strap, for example, each platform could have a space where the user or operator could insert the foot or shoe of the operator. Such space could be defined by walls of the platform which may or may not be elastic.

A projectile having a hook, a nock, or other projection, or other means of capture, that is sized and dimensioned to contact at least a portion of the elastic cable. The projectile can be launched by the device by connecting the hook or other projection to the elastic cable and applying a pulling force to the projectile which causes the elastic cable to extend in length. Once the pulling force is removed, stored kinetic energy retained in the elastic cable causes an opposing force to the projectile, which causes the projectile to move in a generally opposite direction as the elastic cable returns to its original length.

Various objects, features, aspects, and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Figure 16:
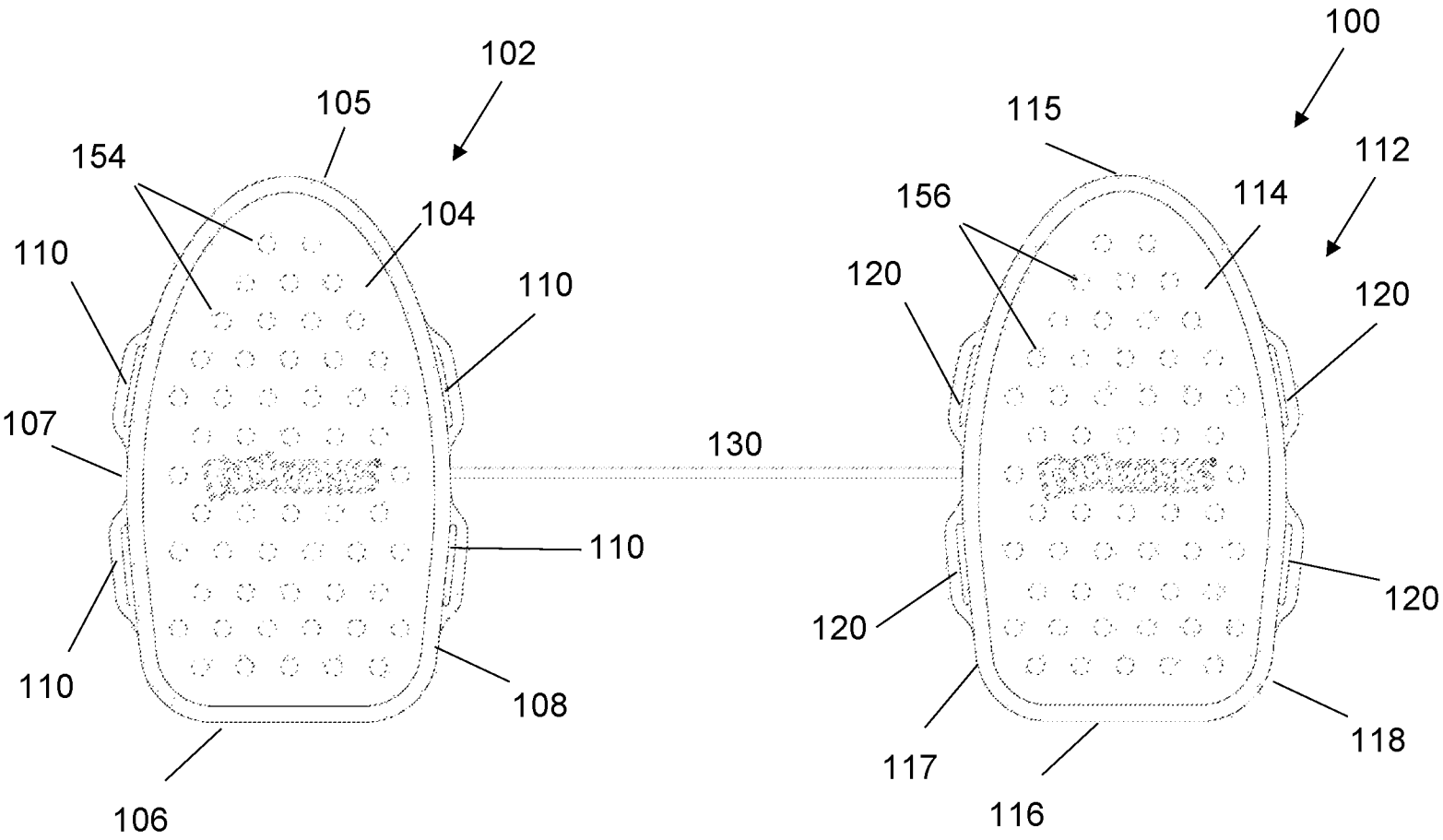
FIG. 16 is a top view of the device with the elastic cable shown in solid line.
Figure 17:
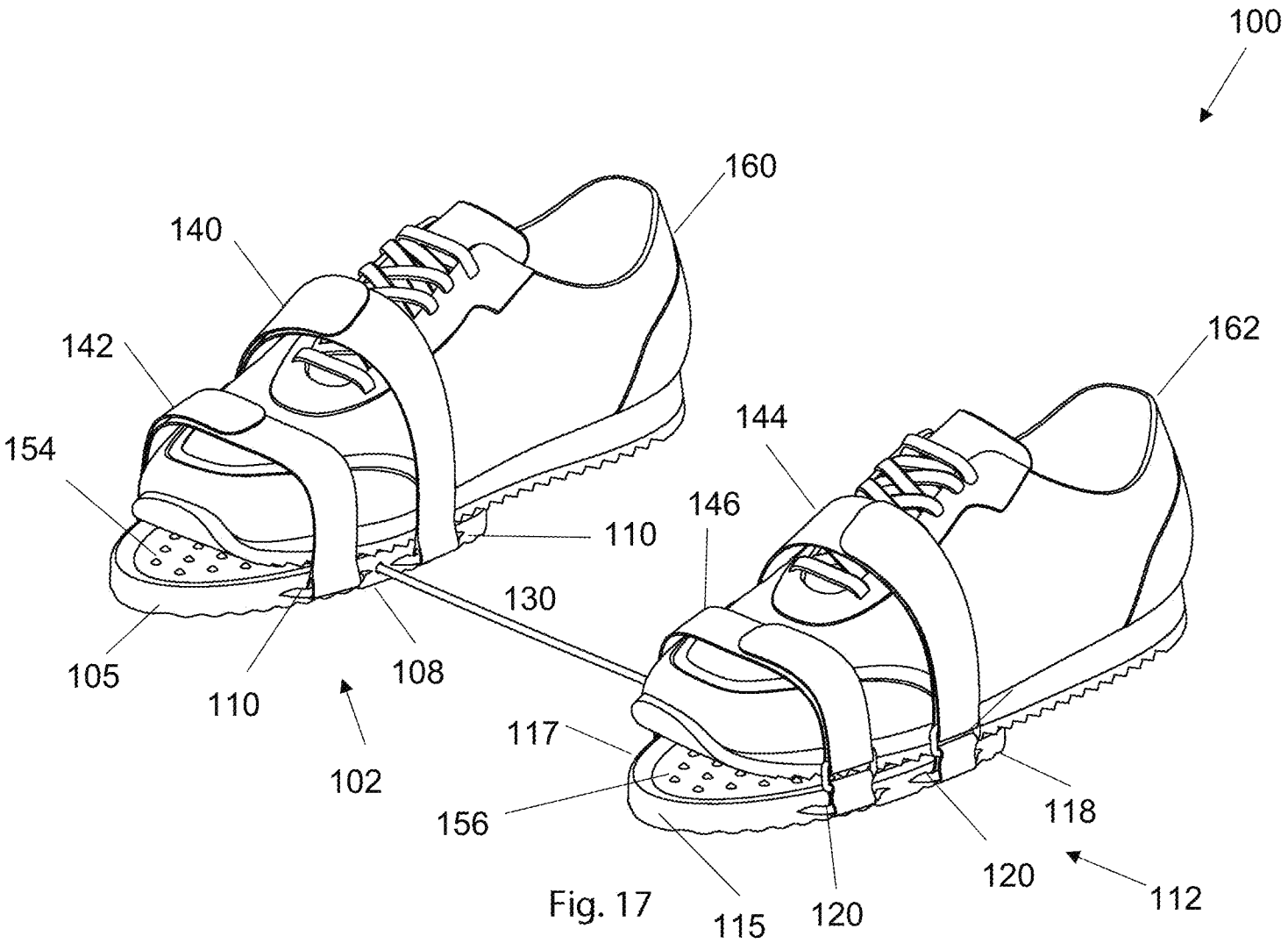
FIG. 17 is a perspective view of the device with the left and right platforms each disposed beneath a shoe.

FIGS. 1-17 illustrate one embodiment of a device 100 for launching a projectile. The device 100 can have a first platform 102 and a second platform 104 connected to one another via an elastic cable 130 as shown in FIGS. 16-17.

It is preferred that the elastic cable 130 has sufficient elasticity to allow a force to stretch the cable 130 and thereby extend its length, such that when the force is removed a projectile 170 coupled to the cable 130 can be propelled in generally the opposite direction by the stored kinetic energy in the elastic cable 130. In some embodiments, the elastic cable 130 has a first length at rest and is configured to be stretched to a second length when sufficient force is applied, where the second length is at least 50% greater than the first length.

Various views of one embodiment of the first platform 102 are presented in FIGS. 1-7. As shown, the first platform 102 comprises a generally rectangular shape with a first end having rounded corners. The platform 102 comprises a first side 105, a second side 106, a third side 107 and a fourth side 108. The first side 105 is disposed opposite of the second side 106, and the third side 107 is disposed opposite of the fourth side 108, with the third and fourth sides 107, 108 being disposed between the first and second sides 105, 106. It is critical that the first platform 102 is sized and dimensioned to be placed under a first foot or shoe 160 of an operator, such that the foot or shoe 160 can be used as a stationary or semi-stationary point when force is applied to the elastic cable 130.

A maximum distance measured between the first side 105 and the second side 106 defines a length L1 of the first platform 102. A maximum distance measured between the third side 107 and the fourth side 108 defines a width W1 of the first platform 102. As shown in the Figures, the length L1 of the first platform 102 is greater than the width W1 of the first platform 102.

The first platform 102 further comprises a first strap 140 or other commercially suitable fastener that is coupled to the first platform 102 and configured to wrap around and thereby secure the first foot or shoe 160 of the operator to the first platform 102. As seen in the Figures, it is contemplated that the first platform 102 could also comprise a second strap 142 that is coupled to the first platform 102 and configured to wrap around and thereby collectively secure the first foot or shoe 160 of the operator to the first platform 102.

Each of the straps 140, 142 preferably is inserted through an eyelet or aperture 110 disposed on opposing third and fourth sides 107, 108 of the first platform 102, such that that straps 140, 142 preferably are inserted through an eyelet or aperture 110 on each of the third and fourth sides 107, 108 of the first platform 102. It is contemplated that each of the straps can be secured using a hook and loop fastener with the hook portion disposed on one portion of the strap and the loop portion disposed on another portion of the strap, such the hooks and loops can contact one another when securing the strap in place. Of course, any other commercially suitable could alternatively be used including, for example, a buckle, a cinch, a ratchet and so forth.

As seen in the Figures, it is preferred that the first platform 102 comprise a planar surface. In some embodiments, the first platform 102 can be inelastic and comprise a plastic or polycarbonate material to provide strength and durability while reducing weight of the device when compared to metal or wood, for example.

Figure 1:
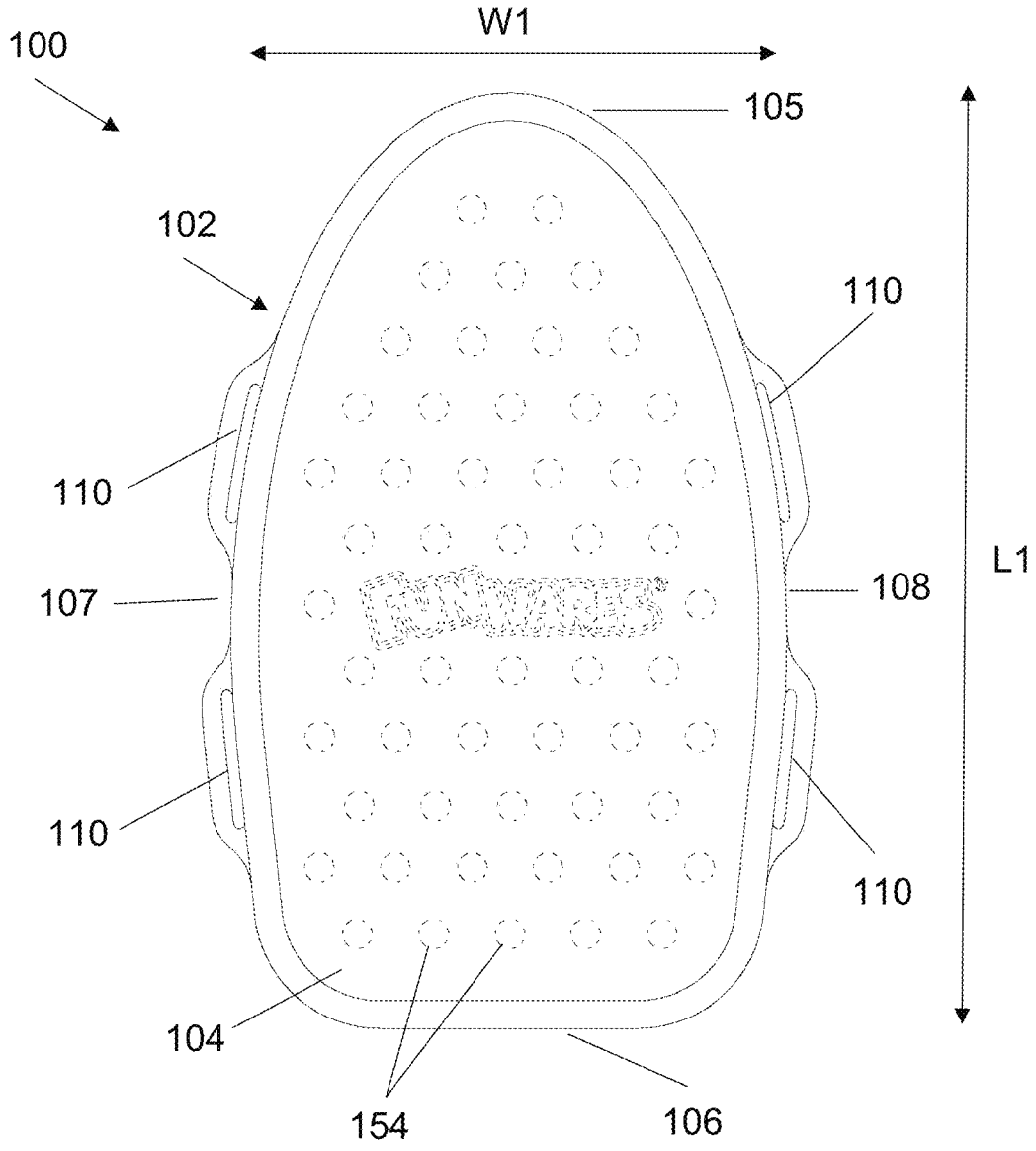
FIG. 1 is a top view of a first or left platform of one embodiment of the device.
Figure 2:
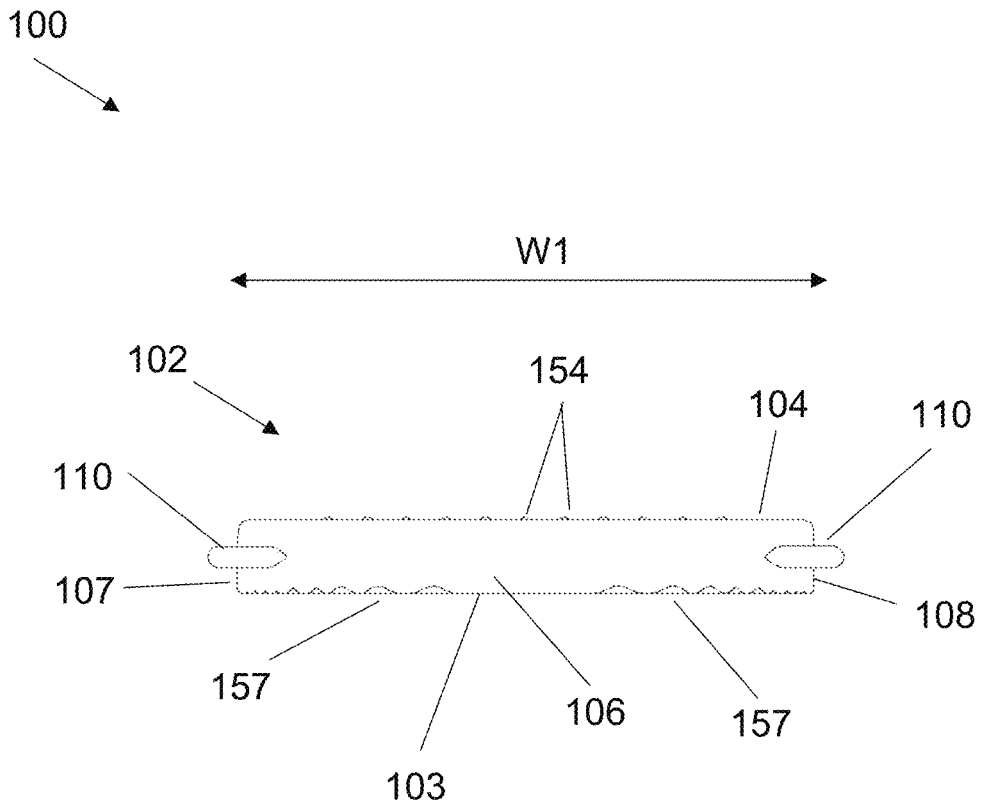
FIG. 2 is a front view of the first or left platform shown in FIG. 1.

As shown best in FIG. 1, the first platform 102 can have an upper surface 104 comprising a set of bumps or other projections 154 that extend upwardly away from the upper surface 104. The set of bumps or other projections 154 can be useful to prevent the operator's foot or shoe 160 from moving with respect to the first platform 102 when the first platform 102 is secured to the first foot or shoe 160 by increasing the friction between the first platform 102 and the foot or shoe 160.

Figure 6:
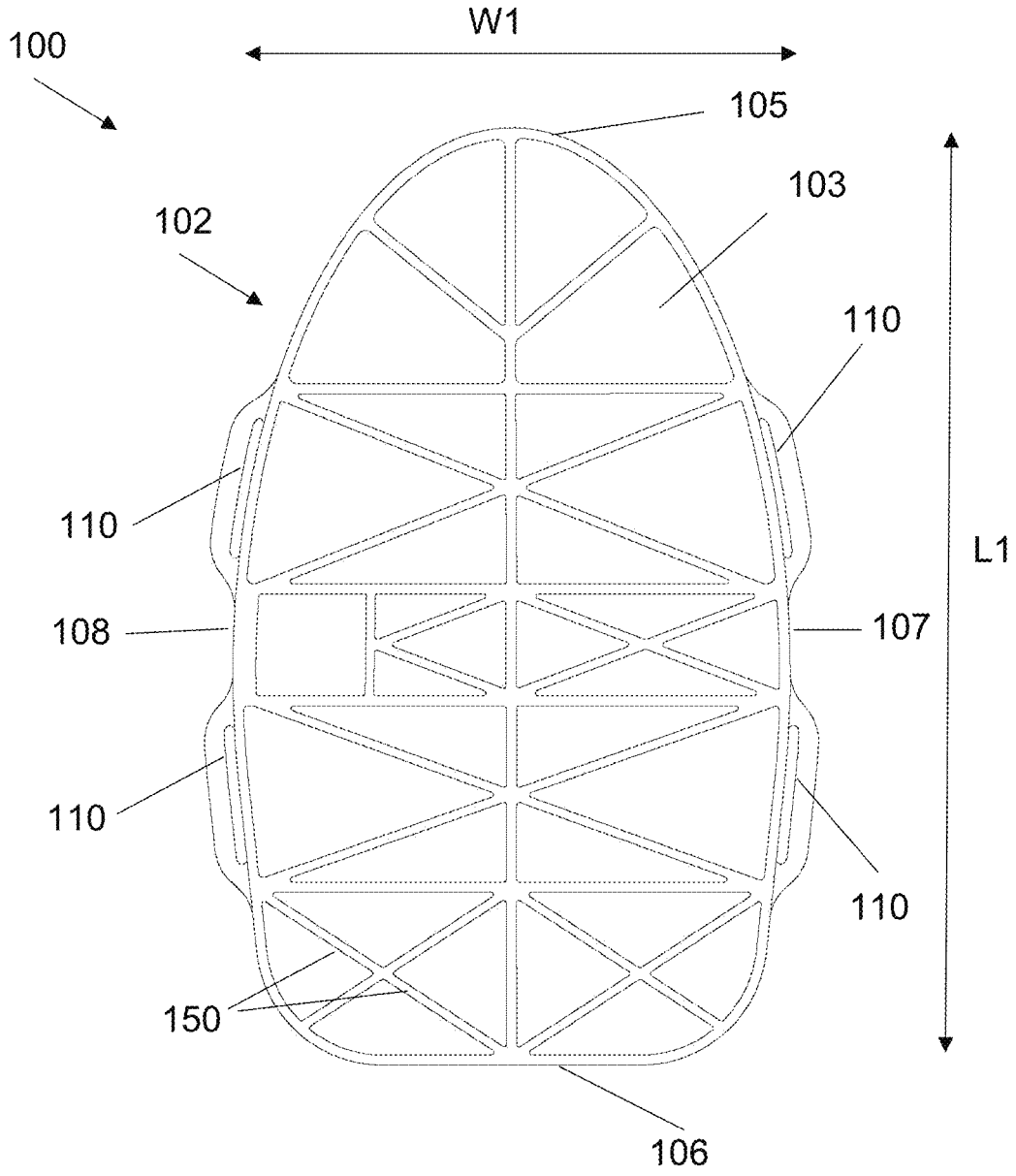
FIG. 6 is a bottom view of the first or left platform shown in FIG. 1.
Figure 7:
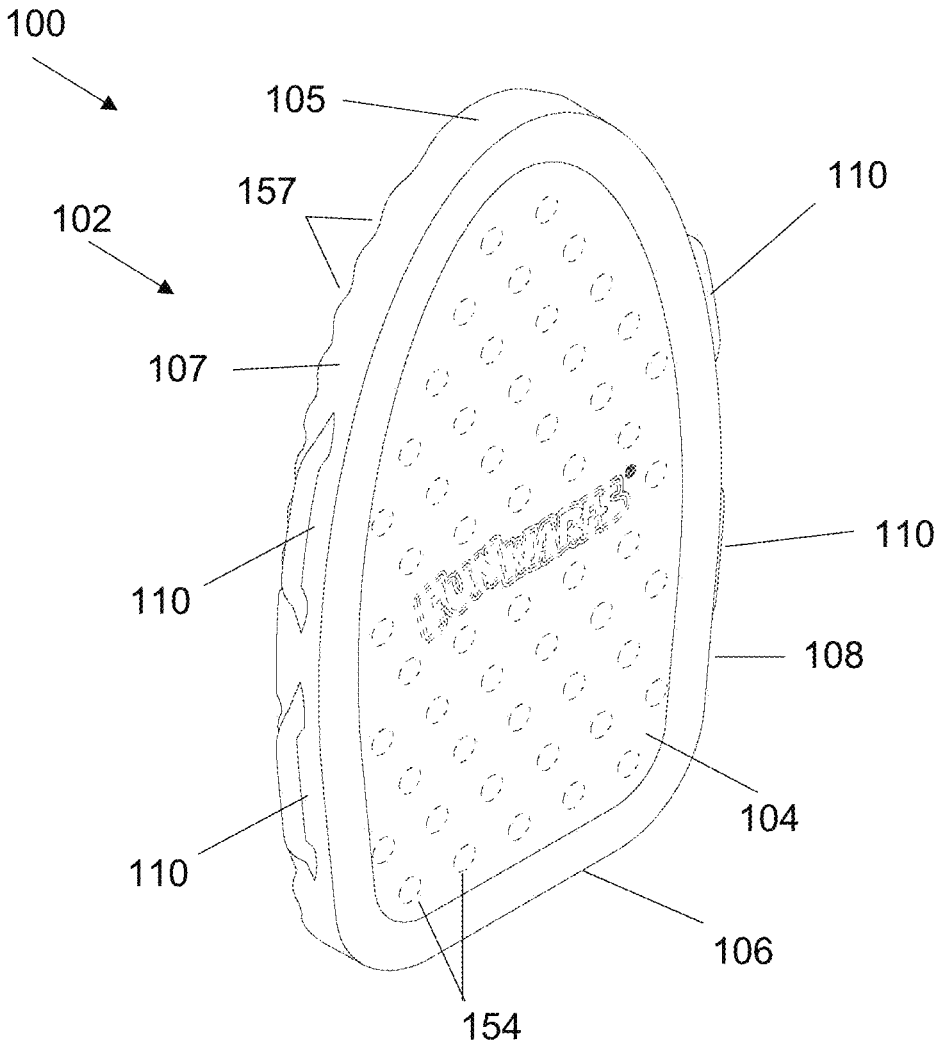
FIG. 7 is a perspective view of the first or left platform shown in FIG. 1.

A lower or bottom surface 103 of the first platform 102 may comprise a plurality of ribs 150 such as shown in FIG. 6 to strengthen the platform 102 while reducing an overall weight of the first platform as well as the material required to injection mold or other produce the first platform 102.

Figure 3:
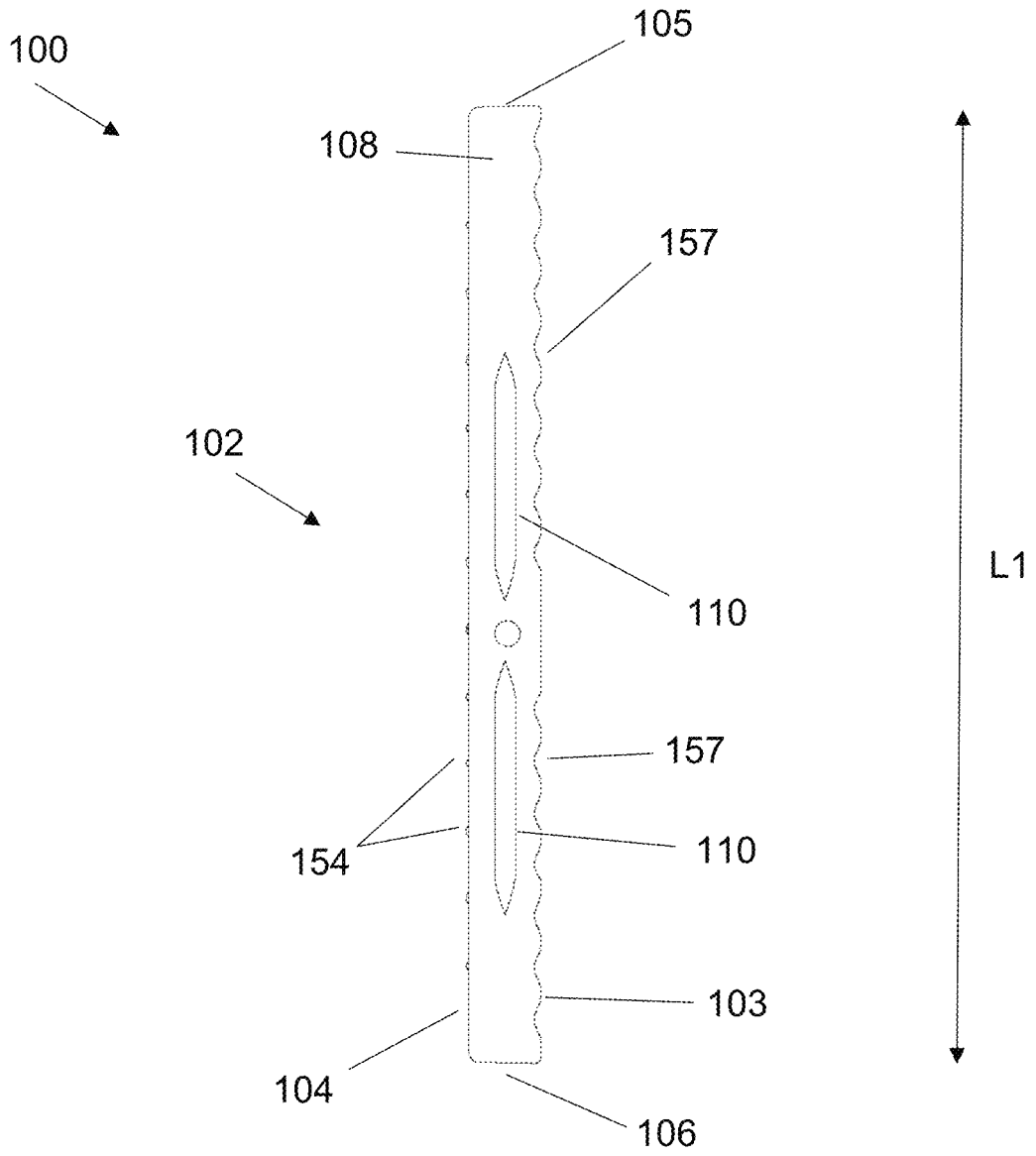
FIG. 3 is a left view of the first or left platform shown in FIG. 1.
Figure 4:
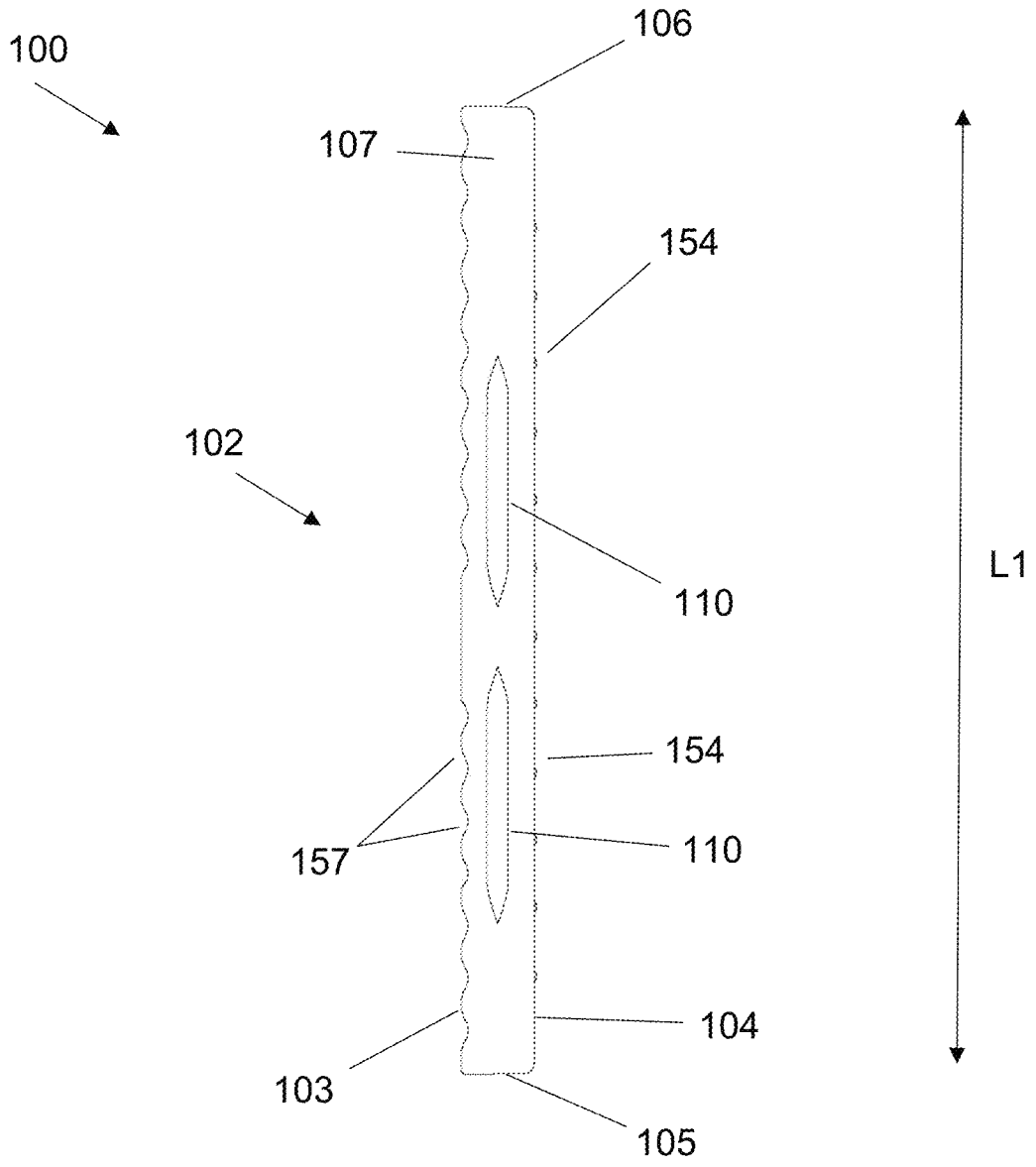
FIG. 4 is a right view of the first or left platform shown in FIG. 1.
Figure 5:
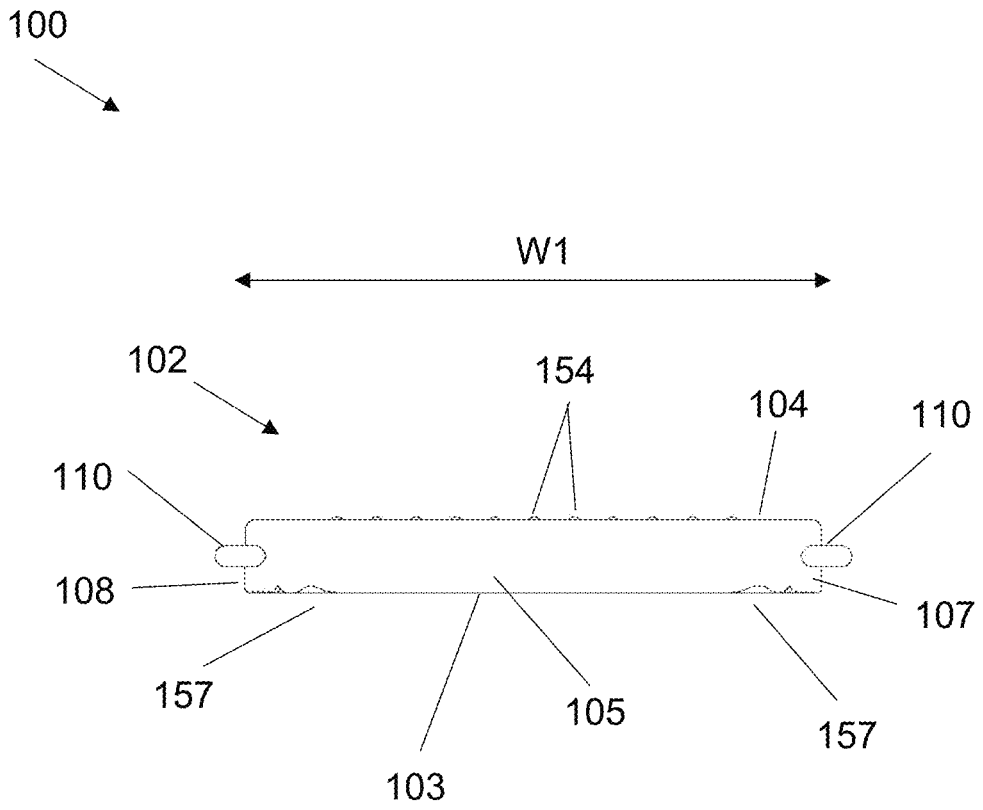
FIG. 5 is a rear view of the first or left platform shown in FIG. 1.

The first platform 102 may also have a series of indentations 157 on the bottom surface 103 as can be seen in FIGS. 3-4, for example.

Various views of one embodiment of the second platform 112 are presented in FIGS. 8-14. As shown, the second platform 112 comprises a generally rectangular shape with a first end having rounded corners. The platform 112 comprises a first side 115, a second side 116, a third side 117 and a fourth side 118. The first side 115 is disposed opposite of the second side 116, and the third side 117 is disposed opposite of the fourth side 118, with the third and fourth sides 117, 118 being disposed between the first and second sides 115, 116. It is critical that the second platform 112 is sized and dimensioned to be placed under a second foot or shoe 162 of an operator, such that the foot or shoe 162 can be used as a stationary or semi-stationary point when force is applied to the elastic cable 130.

A maximum distance measured between the first side 115 and the second side 116 defines a length L2 of the second platform 112. A maximum distance measured between the third side 117 and the fourth side 118 defines a width W2 of the second platform 112. As shown in the Figures, the length L2 of the second platform 112 is greater than the width W2 of the second platform 112.

The second platform 112 further comprises a third strap 144 or other commercially suitable fastener that is coupled to the second platform 112 and configured to wrap around and thereby secure the second foot or shoe 162 of the operator to the second platform 112. As seen in the Figures, it is contemplated that the second platform 112 could also comprise a fourth strap 146 that is coupled to the second platform 112 and configured to wrap around and thereby collectively secure the second foot or shoe 162 of the operator to the second platform 112.

Each of the straps 144, 146 preferably is inserted through an eyelet or aperture 120 disposed on opposing third and fourth sides 117, 118 of the second platform 112, such that that straps 144, 146 preferably are inserted through an eyelet or aperture 120 on each of the third and fourth sides 117, 118 of the second platform 112. It is contemplated that each of the straps 144, 146 can be secured using a hook and loop fastener with the hook portion disposed on one portion of the strap and the loop portion disposed on another portion of the strap, such the hooks and loops can contact one another when securing the strap in place. Of course, any other commercially suitable could alternatively be used including, for example, a buckle, a cinch, a ratchet and so forth.

As seen in the Figures, it is preferred that the second platform 112 comprise a planar surface. In some embodiments, the second platform 112 can be inelastic and comprise a plastic or polycarbonate material to provide strength and durability while reducing weight of the device when compared to metal or wood, for example.

Figure 8:
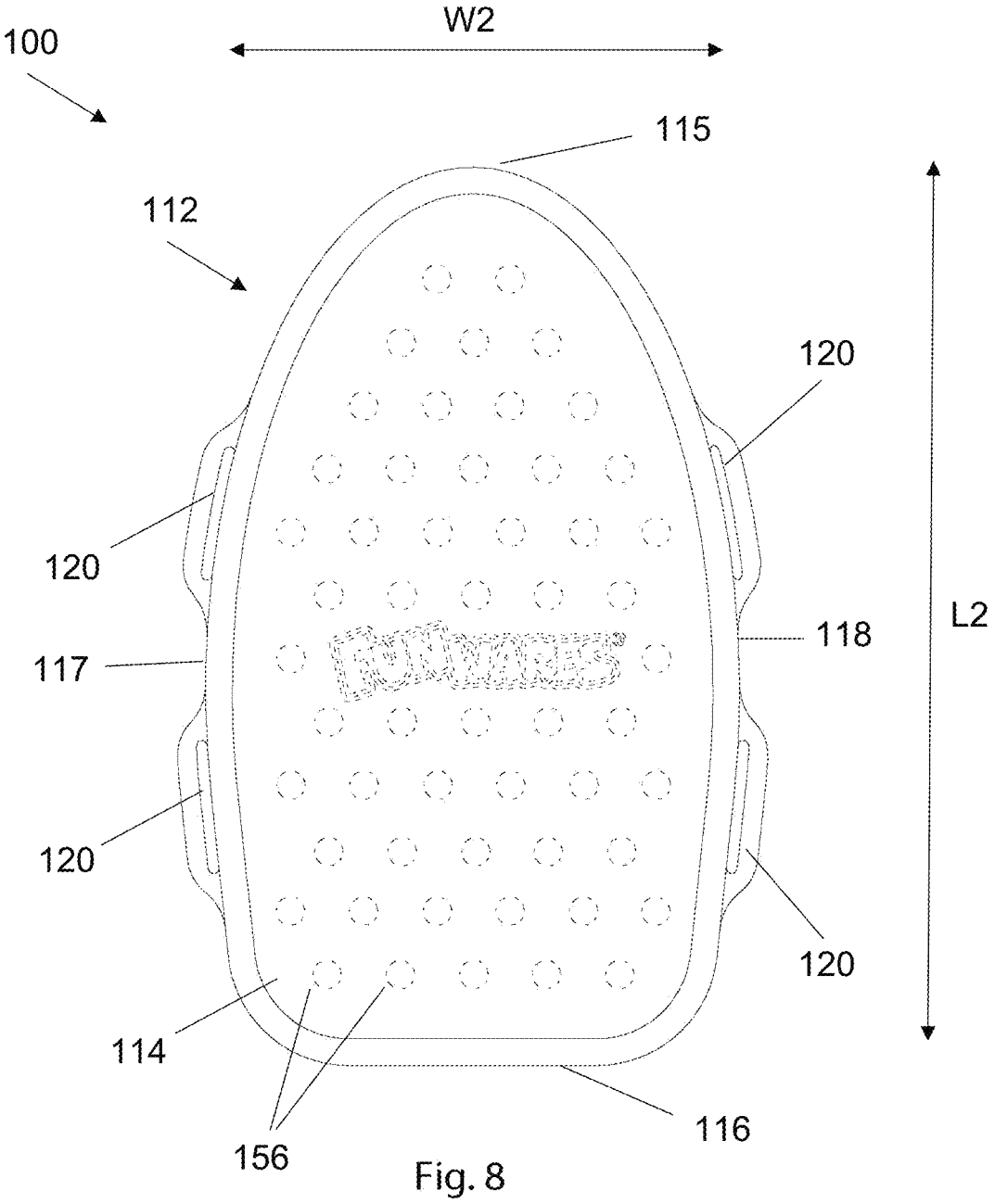
FIG. 8 is a top view of a second or right platform of the device.
Figure 9:
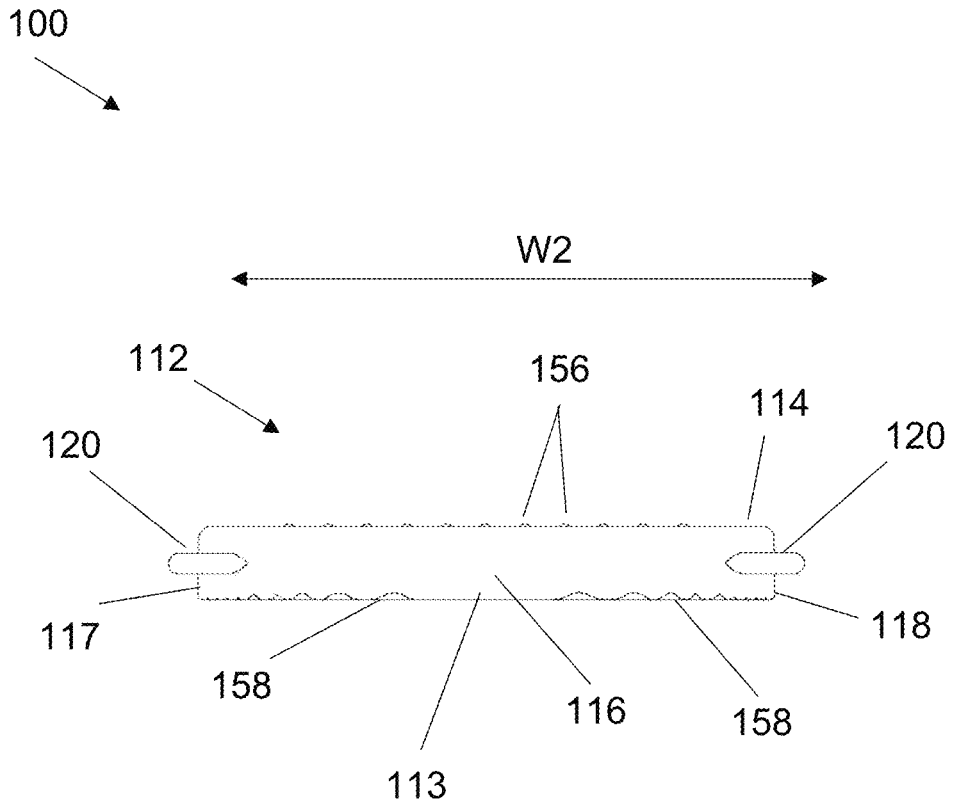
FIG. 9 is a front view of the second or right platform shown in FIG. 8.

As shown best in FIG. 8, the second platform 112 can have an upper surface 114 comprising a set of bumps or other projections 156 that extend upwardly away from the upper surface 114. The set of bumps or other projections 156 can be useful to prevent the operator's foot or shoe 162 from moving with respect to the second platform 112 when the second platform 112 is secured to the second foot or shoe 162 by increasing the friction between the second platform 112 and the foot or shoe 162.

Figure 13:
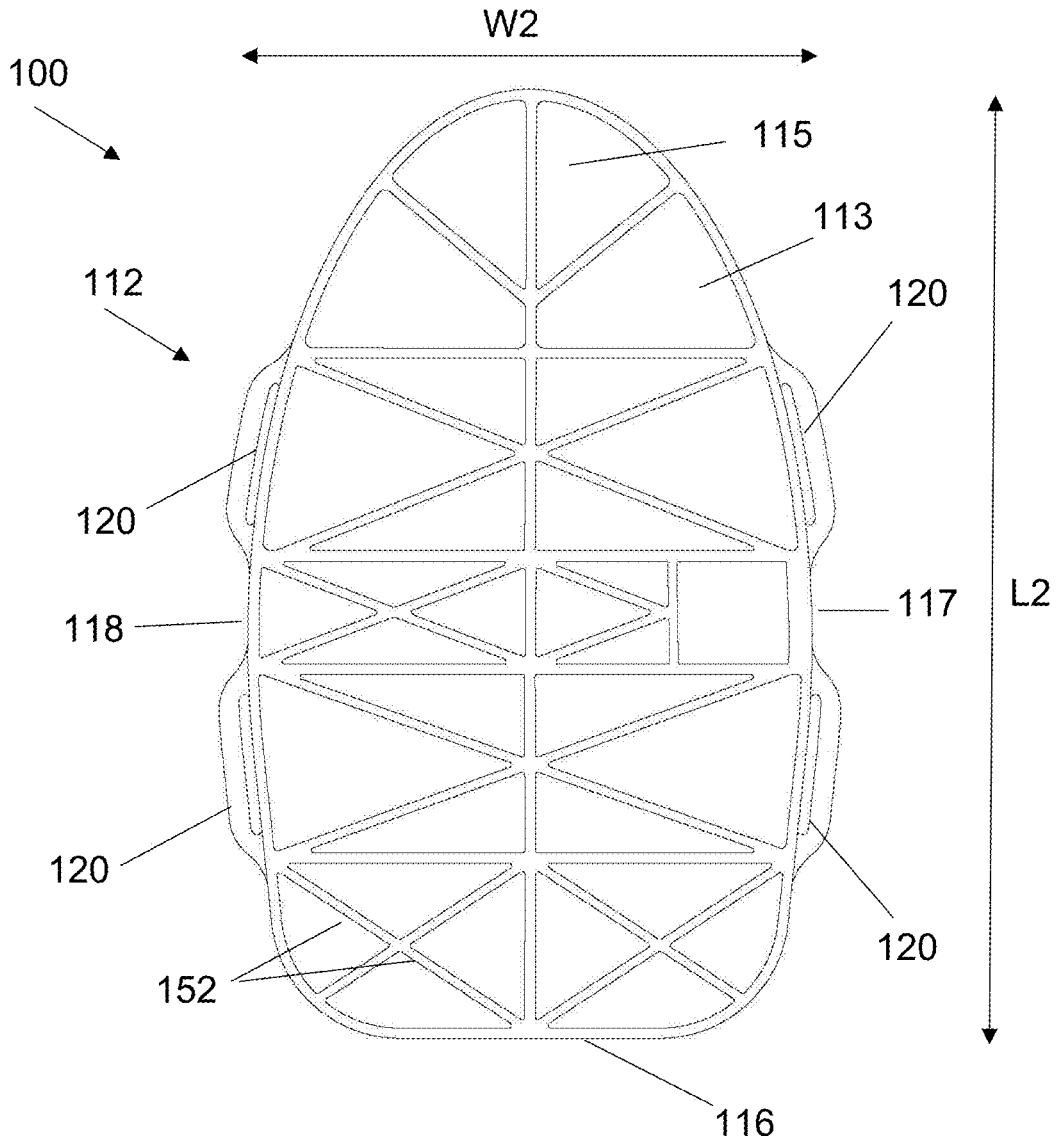
FIG. 13 is a bottom view of the second or right platform shown in FIG. 8.
Figure 14:
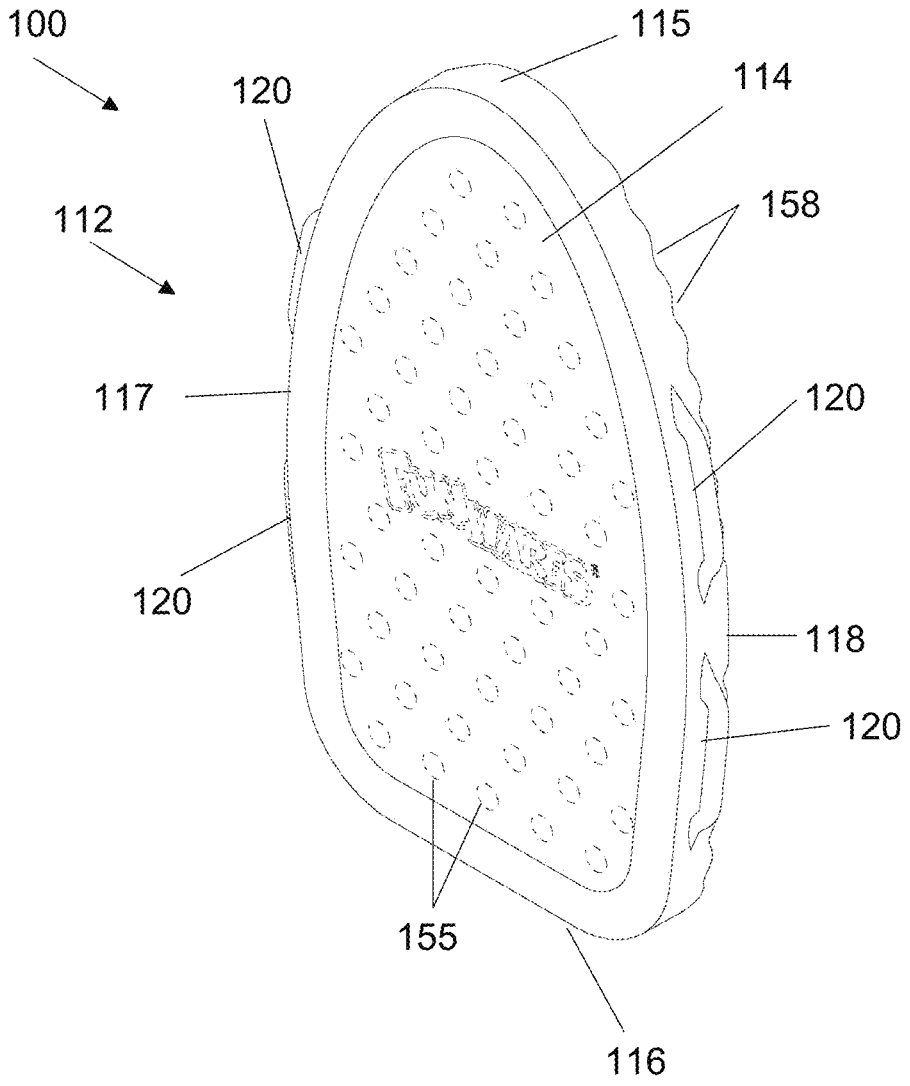
FIG. 14 is a perspective view of the second or right platform shown in FIG. 8.
Figure 15:
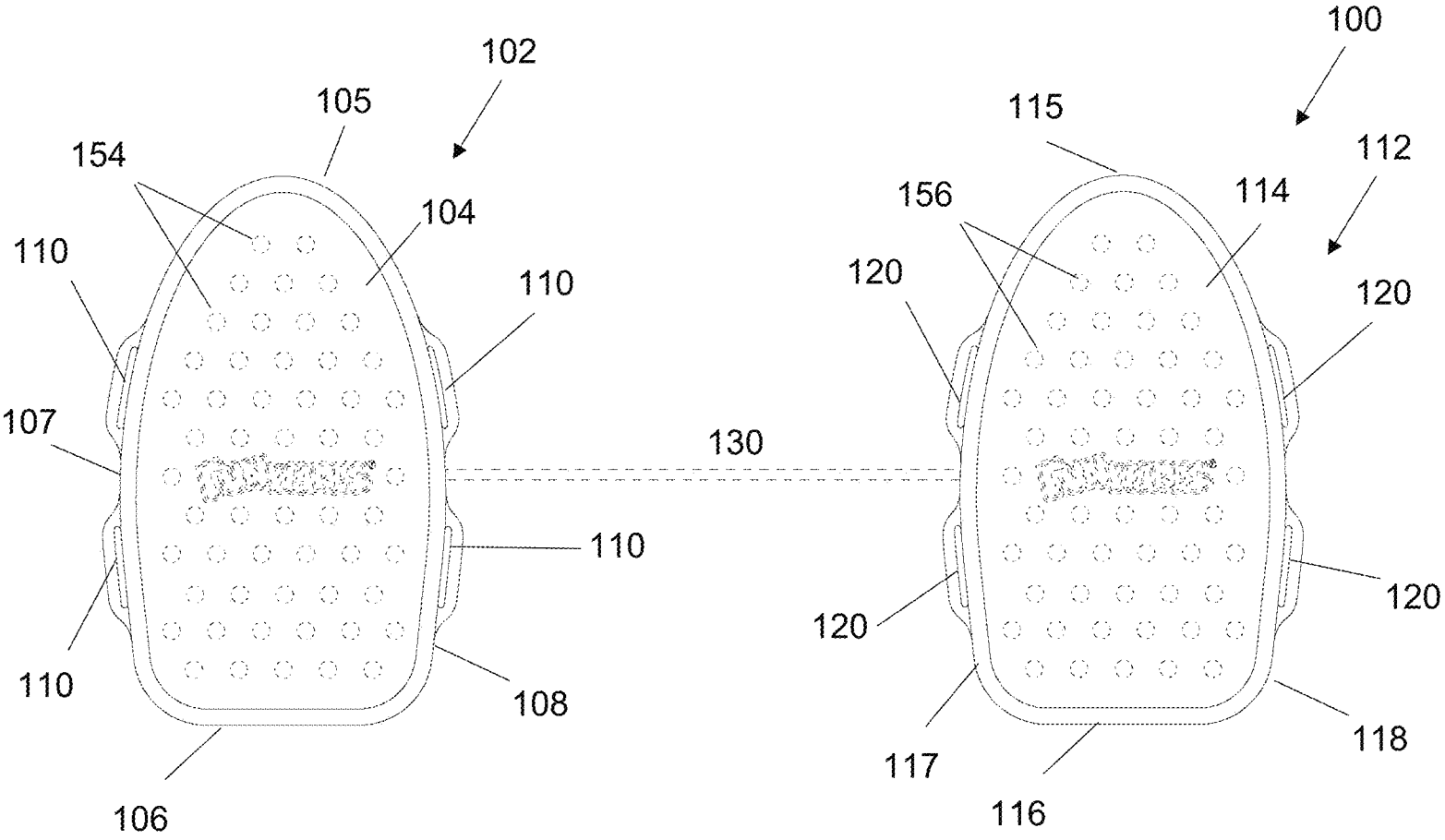
FIG. 15 is a top view of the device with the elastic cable shown in broken line.

A lower or bottom surface 113 of the second platform 112 may comprise a plurality of ribs 152 such as shown in FIG. 13 to strengthen the platform 112 while reducing an overall weight of the first platform as well as the material required to injection mold or other produce the second platform 112.

Figure 10:
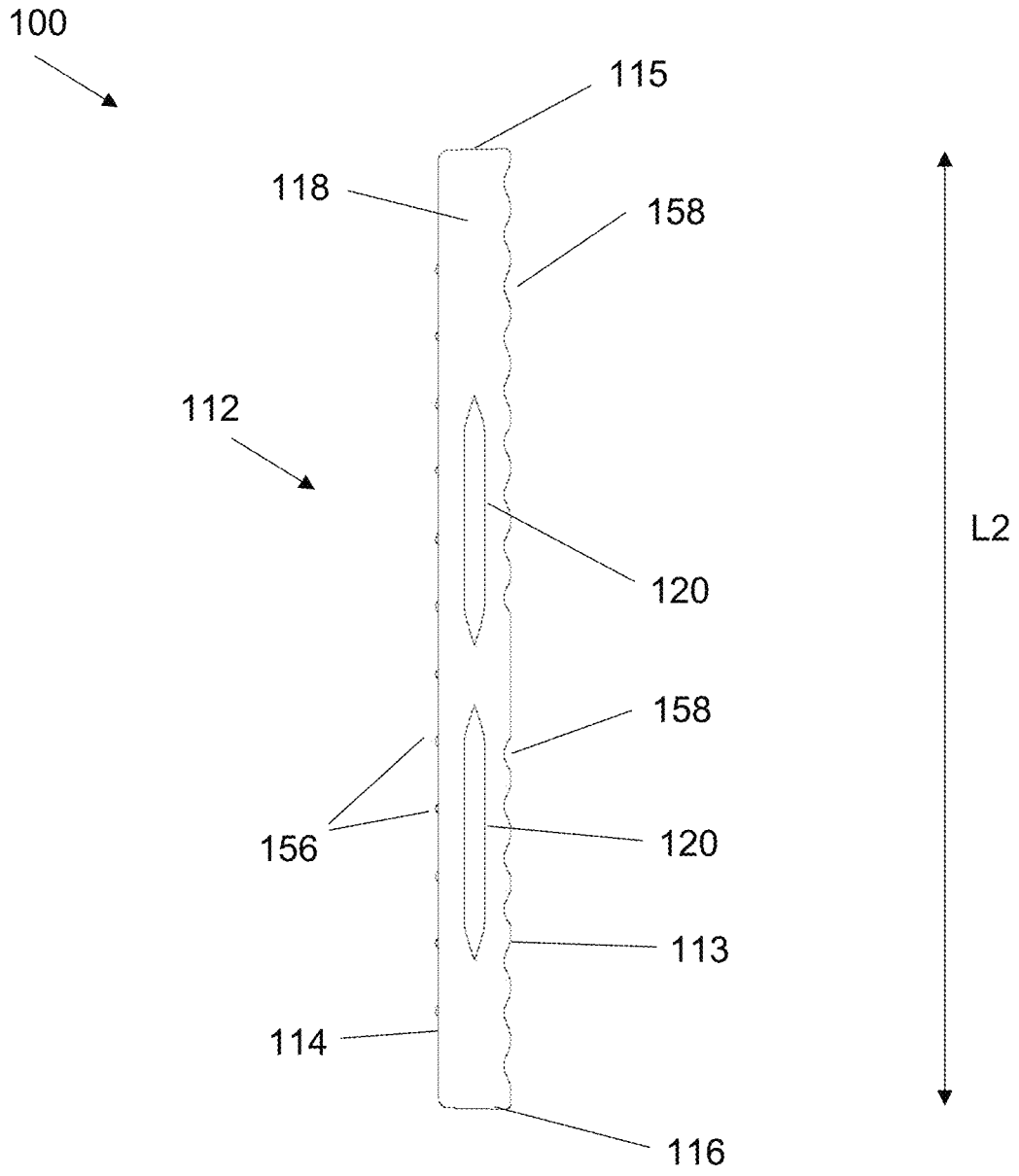
FIG. 10 is a left view of the second or right platform shown in FIG. 8.
Figure 11:
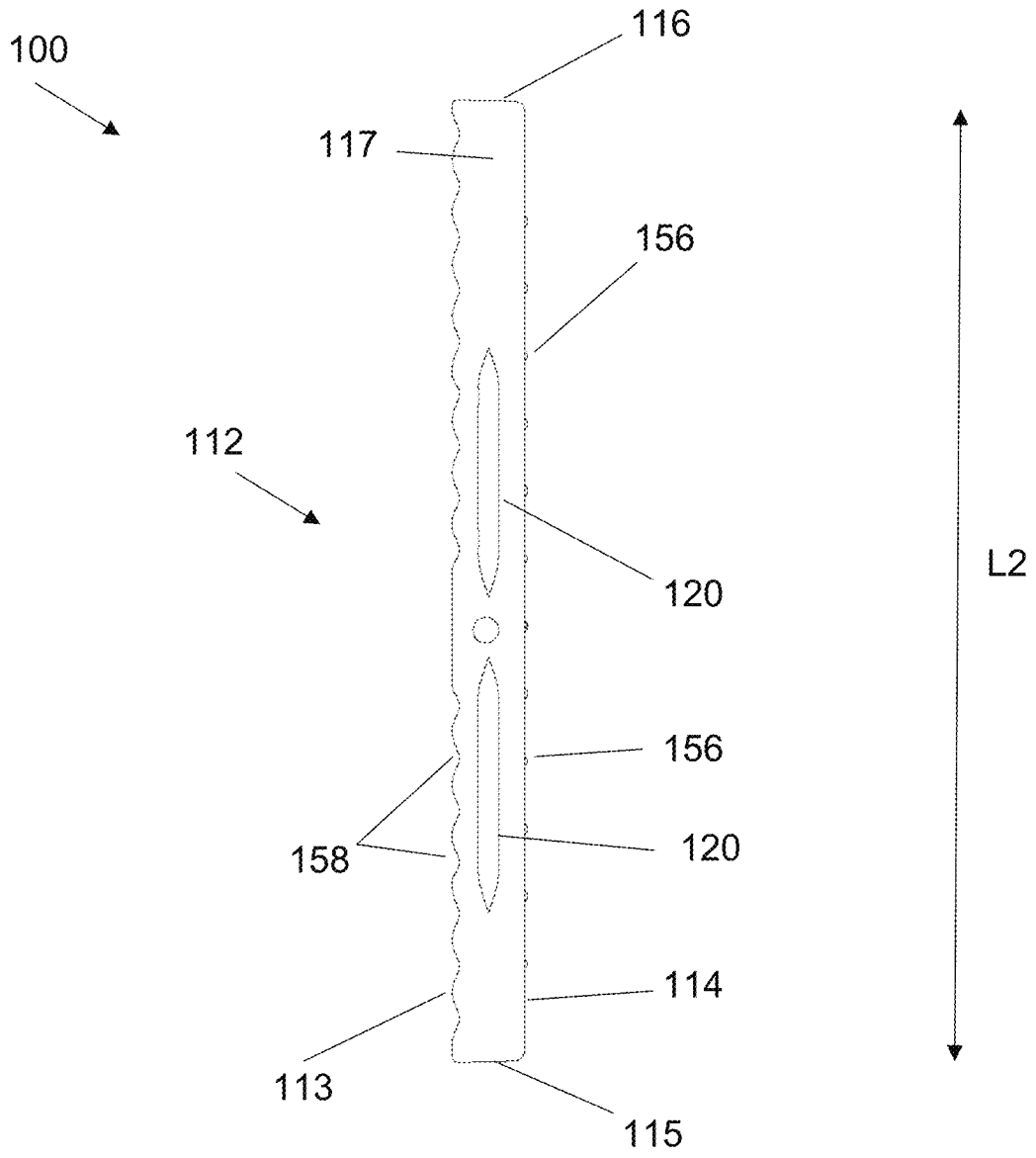
FIG. 11 is a right view of the second or right platform shown in FIG. 8.
Figure 12:
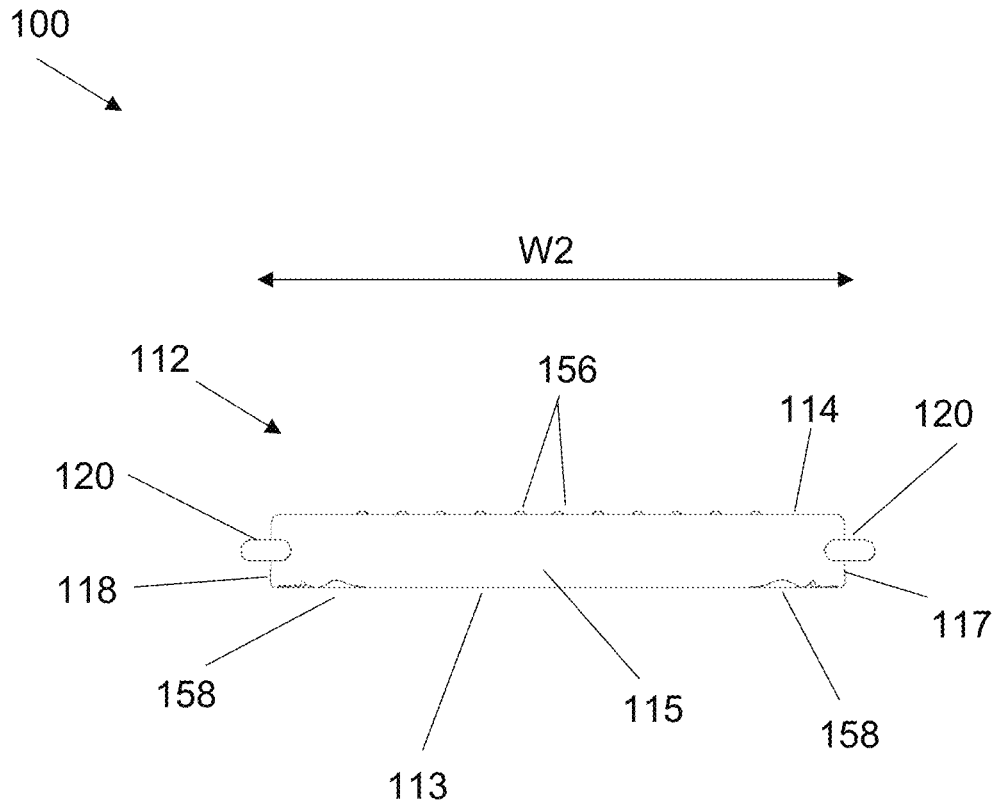
FIG. 12 is a rear view of the second or right platform shown in FIG. 8.

The second platform 112 may also have a series of indentations 158 on the bottom surface 113 as can be seen in FIGS. 10-11, for example.

Although the straps 140, 142, 144, 146 described above are shown as each being a single piece of material, it is alternatively contemplated that one or more of the straps 140, 142, 144, 146 could comprise first and second pieces of material that are coupled together to hold a foot or shoe of the user to one of the platforms.

Figure 18A:
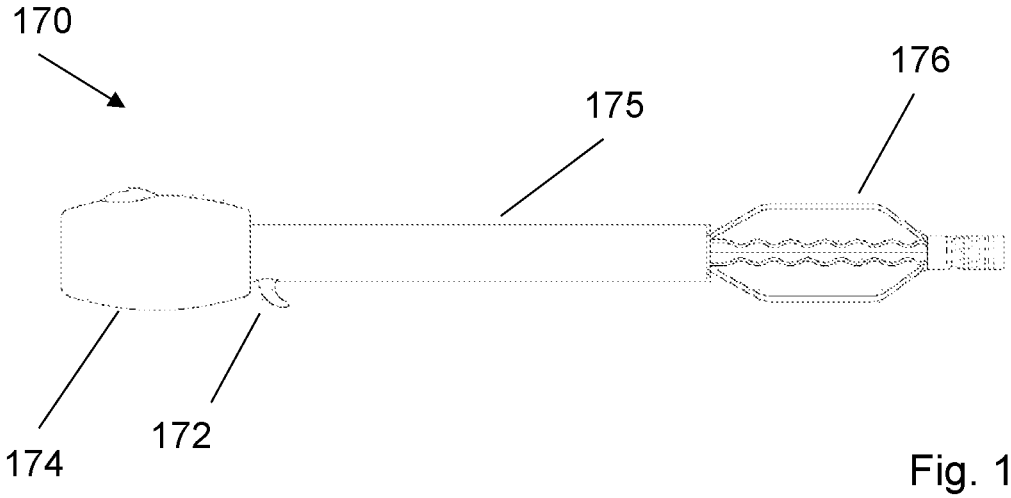
FIGS. 18A-18B are side and perspective views, respectively of one embodiment of a projectile.
Figure 18B:
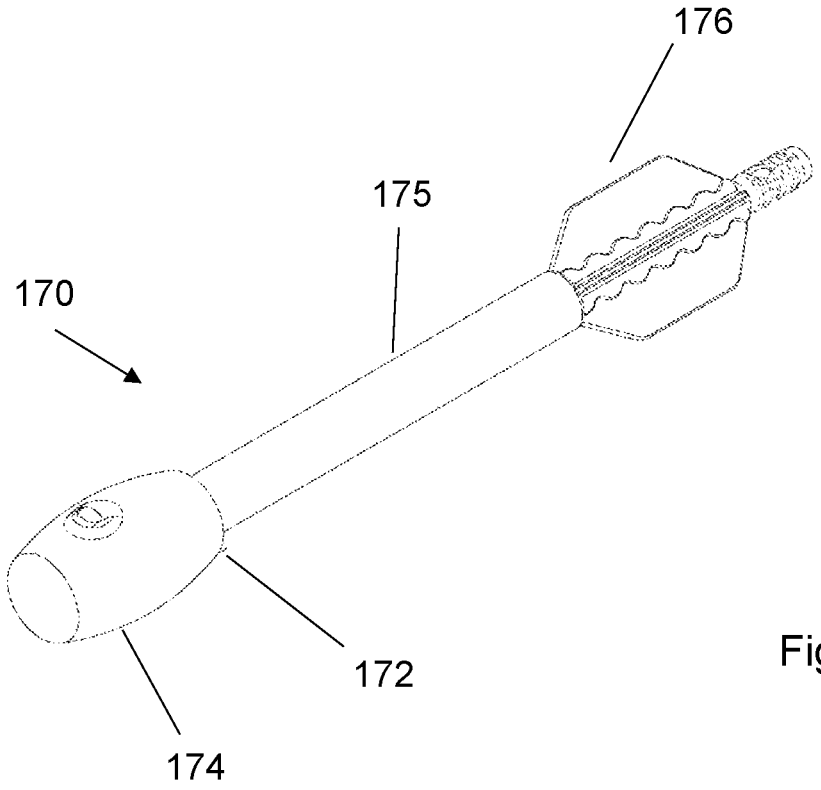

FIGS. 18*a*-18*b* illustrates one embodiment of a projectile 170 for use with the device 100 described above. Projectile 170 preferably comprises a projection 172 extending outwardly from a surface of the projectile 170, where the projection 172 is sized and dimensioned to contact at least a portion of the elastic cable 130. The projection 172 may comprise a hook, a nock, or other projection, or other means of capture, for example.

In some embodiments, the projectile may comprise a head portion 174, a middle portion 175 and a tail portion 176, all connected or coupled together to form the projectile 170. The tail portion 176 may include a set of fins to stabilize the projectile 170 when moving through the air. Of course, different shapes, sizes and configurations of projectiles could be used with device 100 without departing from the scope of the invention described herein, so long as the projectile 170 can removably couple to the elastic cable 130 to launch the projectile 170 as discussed below.

As discussed above, the projectile 170 can be launched by device 100 by connecting the projection 172 to the elastic cable 130 of the device 100 and applying a pulling force to the projectile 170 which causes the elastic cable 130 to extend in length. Once the pulling force is removed from the projectile 170, stored kinetic energy retained in the elastic cable 130 causes an opposing force to the projectile 170, which causes the projectile 170 to move in a generally opposite direction as the elastic cable 130 returns to its original length.

In another aspect, methods of instructing a user to launch a projectile are also contemplated, especially those methods that utilize the device described above and shown in FIGS. 1-17.

First, instructions can be provided that instruct the user or operator to place the first platform beneath a first foot or shoe of the operator and then to wrap and tighten the first fastener about the first foot or shoe of the operator. In a similar manner, the instructions can instruct the user or operator to place the second platform beneath a second foot or shoe of the operator and then to wrap and tighten the second fastener about the second foot or shoe of the operator.

Once the platforms are each secured to one of the user's feet, the user can be instructed to connect the projectile to the elastic cable, such as by using the projection of the projectile.

The user can then be instructed to pull the projectile (and with it the elastic cable) toward the user and then release the projectile which transfers at least some of the elastic force to the projectile to propel the projectile in generally the opposite direction. To permit this to happen, it is preferred that the elastic cable has an elasticity such that (i) when the projectile contacts at least the portion of the elastic cable and a force is applied, a length of the elastic cable increases and (ii) when the force is removed, the length of the elastic cable decreases and a second force is applied to the projectile.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device for launching a projectile, comprising:

a left platform having a generally rectangular shape with first and second opposing sides and third and fourth opposing sides disposed between the first and second sides, wherein a distance between the first and second sides defines a length of the left platform and a distance between the third and fourth opposing sides defines a width of the left platform, and wherein the length is greater than the width of the left platform, and wherein the left platform is sized and dimensioned to be placed under a first foot or shoe of an operator;

a first adjustable strap coupled to the left platform and configured to wrap around the first foot or shoe of the operator;

a right platform having a generally rectangular shape with first and second opposing sides and third and fourth opposing sides disposed between the first and second sides, wherein a distance between the first and second sides of the right platform defines a length of the right platform and a distance between the third and fourth opposing sides of the right platform defines a width of the right platform, and wherein the length of the right platform is greater than the width of the right platform, and wherein the right platform is sized and dimensioned to be placed under the second foot or shoe of the operator;

wherein the left and rights platforms are inelastic;

a second adjustable strap coupled to the right platform and configured to wrap around the second foot or shoe of the operator; and an elastic cable extending from the fourth side of the left platform to the third side of the right platform, wherein the elastic cable connects the left platform to the right platform, wherein the elastic cable is distinct from the first and second straps.

2. The device of claim 1, further comprising:

projectile comprising a projection that is sized and dimensioned to contact at least a portion of the elastic cable, wherein the projection optionally comprises a hook or a nock.

3. The device of claim 1, wherein the left platform and the right platform each comprises a planar surface.

4. The device of claim 1, wherein the left platform comprises first and second apertures disposed on opposing third and fourth sides of the left platform, and wherein the first strap extends through each of the first and second apertures.

5. The device of claim 4, wherein the right platform comprises third and fourth apertures disposed on opposing third and fourth sides of the right platform, and wherein the second strap extends through each of the third and fourth apertures.

6. The device of claim 1, wherein the elastic cable has a first length at rest and is configured to be stretched to a second length when sufficient force is applied, wherein the second length is at least 50% greater than the first length.

7. The device of claim 1, wherein the first strap comprises first and second pieces that are coupled together to hold the first foot or shoe of the operator to the left platform.

8. The device of claim 1, wherein the left and right platforms are composed of a plastic or polycarbonate material.

9. A method of instructing a user to launch a projectile using the device of claim 1, comprising:

instructing the operator to place the left platform beneath the left foot or shoe of the operator and wrap and tighten the first strap about the left foot or shoe of the operator;

instructing the operator to place the right platform beneath the right foot or shoe of the operator and wrap and tighten the second strap about the right foot or shoe of the operator;

instructing the operator to connect a projection of a projectile to the elastic cable;

instructing the operator to pull the projectile connected to the elastic cable toward a body of the operator; and instructing the operator to release the projectile.

10. The device of claim 1, wherein the left platform comprises at least one eyelet on the third or fourth side configured to receive the first strap, and wherein the right platform comprises at least one eyelet on the third or fourth side configured to receive the second strap.

11. The device of claim 1, wherein each of the left and right platforms comprises an upper surface having a set of projections that extend upwardly from the upper surface.

12. A launch system, comprising:

a first platform composed of plastic or polycarbonate material, with a length that is greater than a width of the first platform, wherein the width is defined as a distance between a first second and a second side of the first platform, and wherein the first platform is sized and dimensioned to be placed under a first foot or shoe of an operator;

a first strap coupled to the first platform on the first and second sides and configured to wrap around the first foot or shoe of the operator;

a second platform composed of plastic or polycarbonate material, with a length that is greater than a width of the second platform, wherein the width is defined as a distance between a first second and a second side of the second platform, and wherein the second platform is sized and dimensioned to be placed under a second foot or shoe of the operator;

a second strap coupled to the second platform on the first and second sides and configured to wrap around the second foot or shoe of the operator;

an elastic cable connecting the second side of the first platform to the first side of the second platform; and at least one projectile, wherein the at least one projectile comprises a projection that is sized and dimensioned to contact at least a portion of the elastic cable.

13. The launch system of claim 12, wherein the elastic cable has an elasticity such that (i) when the projectile contacts at least the portion of the elastic cable and a force is applied, a length of the elastic cable increases and (ii) when the force is removed, the length of the elastic cable decreases and a second force is applied to the projectile.

14. The launch system of claim 12, wherein the first platform and the second platform each comprises a generally rectangular and planar surface.

15. The launch system of claim 12, wherein the first platform comprises first and second apertures disposed on opposing third and fourth sides of the first platform, and wherein the first strap extends through each of the first and second apertures.

16. The launch system of claim 15, wherein the second platform comprises third and fourth apertures disposed on opposing third and fourth sides of the second platform, and wherein the second strap extends through each of the third and fourth apertures.

17. The launch system of claim 12, wherein the elastic cable has a first length at rest and is configured to be stretched when sufficient force is applied to a second length that is at least 50% greater than the first length.

18. The launch system of claim 12, wherein the first strap comprises first and second pieces that are coupled together to hold the first foot or shoe of the operator to the first platform.

19. The launch system of claim 12, wherein the first and second platforms are inelastic.

* * * * *